United States Patent [19]

Tomiyama et al.

[11] Patent Number: 4,833,063

[45] Date of Patent: May 23, 1989

[54] COLOR DIFFUSION TRANSFER ELEMENT COMPRISING TWO NEUTRALIZING LAYERS AND TWO TIMING LAYERS

[75] Inventors: Hideki Tomiyama; Ikutaro Horie; Masaki Satake, all of Kanagawa, Japan

[73] Assignee: Fuji Photo Film Co., Ltd., Kanagawa, Japan

[21] Appl. No.: 138,774

[22] Filed: Dec. 29, 1987

[30] Foreign Application Priority Data

Dec. 29, 1986 [JP] Japan ..... 61-315538

[51] Int. Cl.[4] ..... G03C 5/54; G03C 7/00

[52] U.S. Cl. ..... 430/216; 430/215

[58] Field of Search ..... 430/216, 237

[56] References Cited

U.S. PATENT DOCUMENTS

| | | | |
|---|---|---|---|
| 3,362,819 | 1/1968 | Land | 430/216 |
| 3,734,727 | 5/1973 | Milligan | 430/216 |
| 4,356,249 | 10/1982 | Abel et al. | 430/216 |
| 4,551,410 | 11/1985 | Tomiyama et al. | 430/216 |

OTHER PUBLICATIONS

"Neutralizing Materials in Photographic Elements", *Research Disclosure,* No. 12331, 7/1974, pp. 22–24.

*Primary Examiner*—Richard L. Schilling
*Attorney, Agent, or Firm*—Sughrue, Mion, Zinn, Macpeak and Seas

[57] ABSTRACT

A color diffusion transfer photographic element comprised of a light-sensitive dye release and receiving sheet and a cover sheet, wherein development, dye release and dye transfer occur in the presence of an alkaline processing solution, and wherein the cover sheet is provided with a neutralizing system which causes neutralization by an alkaline processing solution to proceed by at least a first and second stage, wherein the first stage is characterized in that neutralization (lowering) of the pH of an alkaline processing solution occurs to the extent to interrupt development and dye release reactions but at which the transfer of a dye for forming a transfer image can continue, and a second stage at which the pH of the processing solution is gradually lowered to a final value which is stably maintained over prolonged storage, the photographic element characterized in that the neutralizing system comprises at least a neutralizing layer, a second neutralization timing layer, an auxiliary neutralizing layer, and a first neutralization timing layer as viewed from the support side, and that said auxiliary neutralizing layer contains 10 to 100% by weight of a polymer containing as a constituent a monomer unit represented by the general formula:

wherein R represents a hydrogen atom or substituted or substituted or unsubstituted alkyl group; X represents a hydrogen atom or substituted or unsubstituted alkyl group, hydroxy group or cyano group, or halogen atom; Y represents a monomer unit obtained by copolymerization of at least one monomer selected from copolymerizable ethylenically unsaturated carboxylic acid, acid anhydride, half ester of acid anhydride, and salts thereof; and a represents a mole percentage of 30 to 70%.

9 Claims, No Drawings

COLOR DIFFUSION TRANSFER ELEMENT COMPRISING TWO NEUTRALIZING LAYERS AND TWO TIMING LAYERS

FIELD OF THE INVENTION

The present invention relates to a dye transfer or receiving element for use in color diffusion transfer photography. Particularly, the present invention relates to a color diffusion transfer (DTR color) photographic element in which the processing solution neutralizing process in the neutralizing system is effected by two stages. More particularly, the present invention relates to a color diffusion transfer photographic element which provides improved sharpness, aftertransfer characteristic, and image preservability.

BACKGROUND OF THE INVENTION

It is well known in ordinary photographic process and diffusion transfer photographic process that a temporary barrier layer may be provided between layers in a photographic element into which a processing solution penetrates. Particularly in the diffusion transfer process, where a neutralizing system is used for the purpose of stopping development, stabilizing the image, or like purpose, it is well known that such a temporary barrier layer may be used in the neutralizing system for the purpose of "timing" the neutralization to prevent the neutralizing layer from neutralizing the developing solution faster than required and hence keep the maximum density constant. A temporary barrier layer to be used for such a purpose is called a timing layer. Examples of such a timing layer are disclosed in U.S. Pat. Nos. 4,061,496, 4,056,394, and 4,201,587, and Japanese Patent Application (OPI) Nos. 72622/78 (corresponding to U.S. Pat. No. 4,199,362), and 141644/82 (the term "OPI" as used herein means an "unexamined published aplication").

In general, the development reaction in silver halide photographic process proceeds slowly at a low temperature but proceeds more rapidly at an elevated temperature. Accordingly, if the diffusion transfer process is used in instant photography where, unlike in the ordinary photographic process wherein the temperature for development may be controlled, the photographic material must be capable of consistent development despite various temperatures. It is therefore extremely important to make the neutralization system of the photographic element capable of compensating for the fluctuation in rate of development due to fluctuation in temperature, i.e., to accelerate the neutralization of the developing solution at an elevated temperature where the development reaction proceeds more rapidly but retard the neutralization of the developing solution at a low temperature where the development reaction proceeds slowly. In this manner, it is possible to obtain an excellent image regardless of development temperature. A large number of examples of timing layers having such a temperature compensation function are disclosed in the foregoing patents.

In the so-called monosheet type diffusion transfer photography, a phenomenon called "aftertransfer" is often observed over the maximum density portion, gradation portion, and minimum density portion with the passage of time (a few days to a few weeks) after formation of image. This phenomenon remarkably deteriorates the picture quality. In this phenomenon, while most of the dye released upon processing migrates to the mordant layer, some of the dye released is left in layers other than the mordant layer. The dye thus left in other layers gradually migrates to the mordant layer with the passage of time. This causes aftertransfer. The cover sheet containing such a timing layer as disclosed in the foregoing patents is not effective in inhibiting such a phenomenon. Even if the timing layer has somewhat of an effect, it is disadvantageous in that the transfer image has a poor sharpness.

Japanese Patent Application (OPI) No. 19137/85 made it possible to inhibit afertransfer without deteriorating sharpness by using a photographic element. Specifically, in a neutralizing system for lowering the pH of an alkaline processing solution, the processing solution neutralizing process proceeds by two different stages. (The neutralizing system consists of a neutralizing layer and a timing layer which is directly or indirectly laminated above or under the neutralizing layer in a positional relationship such that the alkaline processing solution reaches the neutralizing layer through the timing layer.) More specifically, the photographic element as disclosed in Japanese Patent Application (OPI) No. 19137/85 is characterized in that the neutralization reaction proceeds by at least two stages such that in the first stage the pH of the processing solution (photographic system) is lowered to the extent that the development and dye release reaction is interrupted while the transfer of a dye for forming a transfer image can continue, and in the second stage the pH of the processing solution (photographic system) is gradually lowered to a final value withstanding prolonged storage, as a result of which the dye remains immobilized and the image remains stable. The first neutralizing stage is preferably characterized by a rapid pH change. This is a so-called "inverted S-shaped" pH drop in which the pH value shows a rapid drop after being maintained high for a certain period of time. On the contrary, the second neutralizing stage is preferably characterized by a relatively slow pH drop. However, the second neutralizing process may show an inverted S-shaped pH drop. Such a two-stage neutralizing process can be accomplished with a neutralizing system layer prepared by coating on a support a neutralizing layer, a second timing layer, an auxiliary neutralizing layer, and a first timing layer in this order. Alternatively, if a neutralizing layer capable of gradual neutralization is used, a second timing layer can be omitted. In this case, the neutralizing system layer can be provided by coating on a support such a neutralizing layer, an auxiliary neutralizing layer, and a first timing layer in this order.

The pH drop process (mode) can be freely controlled by properly adjusting the component, composition and added amount of the above described timing layer. That is, the period (x) during which the pH is maintained high can be adjusted by the first timing layer, the pH drop at the first stage can be controlled by the auxiliary neutralizing layer, and the pH drop process after the period x can be controlled by the second timing layer and the neutralizing layer. The afertransfer can be effectively inhibited by properly adjusting the neutralizing process. The more positive temperature coefficient the first timing layer has, i.e. the lower the temperature of the first timing layer is, the longer is timing. In other words, the first timing layer preferably is slow in neutralization.

On the other hand, U.S. Pat. No. 4,356,249 describes an improvement in the processing temperature dependence of a color diffusion transfer photographic film unit (assemblage) containing a positive redox compound as a dye image forming compound. In accordance with the above described U.S. patent, the improvement can be accomplished by providing first and second timing layers and an auxiliary neutralizing layer as an additional neutralizing layer between the first timing layer and the second timing layer. (The first timing layer has a negative temperature coefficient.) In this photographic system, the above described auxiliary neutralizing layer is designed to inhibit the release of a dye from the positive redox compound involved in the development of silver halide to a much higher extent at a low temperature than at an elevated temperature in order to improve the processing temperature dependence of the system. Thus, this photographic system is not intended to inhibit the afertransfer of a diffusive dye released from the positive redox compound. Accordingly, this photographic system has no effect of inhibiting afertransfer.

An image formed by processing may be gradually deteriorated even in a dark place particularly when stored at an elevated temperature and a high humidity. This causes a remarkable deterioration of picture quality. Particularly, magenta dyes are subject to discoloration due to their structure. In effect, however, such a discoloration is often offset by the above described aftertransfer which causes a color intensification. However, if a neutralizing system as disclosed in Japanese Patent Application (OPI) No. 19137/85 is used to inhibit aftertransfer, discoloration is more remarkable than color intensification. Accordingly, the photographic system containing such a neutralizing system is disadvantageous in that it is subject to deterioration of picture quality after being stored at an elevated temperature and a high humidity.

Thus, it has been desired to improve the picture quality preservability so that a complete system free of color intensification or discoloration can be obtained.

SUMMARY OF THE INVENTION

It is therefore an object of the present invention to provide a color diffusion transfer photographic element, particularly an integrated color diffusion transfer photographic element which provides improved sharpness and afertransfer characteristics and an excellent image preservability.

The above and other objects of the present invention will become more apparent from the following detailed description and examples.

These objects of the present invention are accomplished with a color diffusion transfer photographic element comprised of a light-sensitive dye release and receiving sheet and a cover sheet, wherein development, dye release and dye transfer occur in the presence of an alkaline processing solution, and wherein the cover sheet is provided with a neutralizing system which causes neutralization by an alkaline processing solution to proceed by at least a first and a second stage, wherein the first stage is characterized in that neutralization (lowering) of the pH of an alkaline processing solution occurs to the extent to interrupt development and dye release reactions but at which the transfer of a dye for forming a transfer image can continue, and a second stage at which the pH of the processing solution is gradually lowered to a final value which is stably maintained over prolonged storage, the photographic element characterized in that the neutralizing system comprises at least a neutralizing layer, a second neutralization timing layer, an auxiliary neutralizing layer, and a first neutralization timing layer as viewed from the support side, and that said auxiliary neutralizing layer contains 10 to 100% by weight of a polymer containing as a constituent a monomer unit represented by the general formula (I):

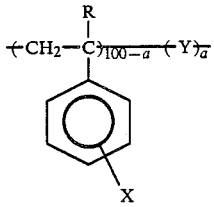

(I)

wherein R represents a hydrogen atom or substituted or unsubstituted alkyl group; X represents a hydrogen atom, a substituted or unsubstituted alkyl group, a hydroxy group, a cyano group, or a halogen atom; Y represents a monomer unit obtained by copolymerization of at least one monomer selected from a copolymerizable ethylenically unsaturated carboxylic acid, acid anhydride, half ester of acid anhydride, and a salt thereof; and a represents a mole percentage of 30 to 70%.

DETAILED DESCRIPTION OF THE INVENTION

Preferred among polymers containing as a constituent a monomer unit represented by the general formula (I) (hereinafter referred to as "present copolymers") is a copolymer represented by the general formula (II):

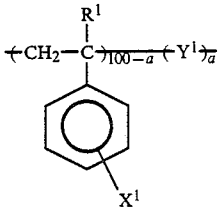

(II)

$R^1$ represents a hydrogen atom or a substituted or unsubstituted alkyl group containing 1 to 6 carbon atoms. Preferred examples of such an unsubstituted alkyl group include methyl group and ethyl group. Preferred examles of such a substituted alkyl group include a hydroxymethyl group, a halomethyl group (halogen atom is chlorine, bromine, iodine, or the like), and a cyanomethyl group. $R^1$ is particularly preferably a hydrogen atom or a methyl group.

$X^1$ represents a hydrogen atom, a substituted or unsustituted alkyl group, a hydroxy group, a cyano group, or a halogen atom (preferably, chlorine, bromine, iodine, or the like). Examples of the alkyl moiety of such a substituted or unsubstituted alkyl group include a methyl group, an ethyl group, a n-propyl group, an isopropyl group, a n-butyl group, an amyl group, a n-hexyl group, and a n-dodecyl group. Preferred among these groups are a methyl group, an ethyl group, and an isopropyl group. Examples of the substituents constituting such a substituted alkyl group include a halogen atom (such as chlorine, bromine, and iodine), a hydroxy group, and a cyano group. Preferred among these substituents are a chlorine atom and a hydroxy group. $X^1$ is particularly preferably a hydrogen atom, a chlorine atom, a hydroxy group, or a methyl group.

$Y^1$ represents a copolymerizable ethylenically unsaturated carboxylic monomer, acid anhydride monomer, half ester monomer of acid anhydride, and salts thereof. Specific examples of preferred monomers represented by $Y^1$ will be shown below, but the present invention should not be construed as being limited thereto.

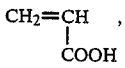

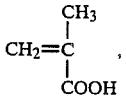

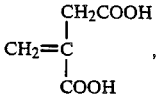

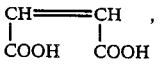

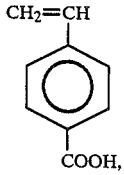

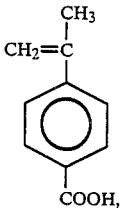

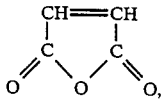

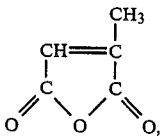

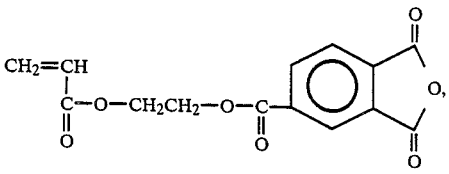

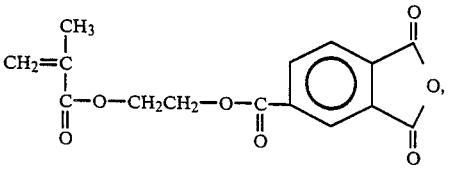

-continued

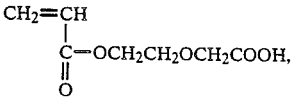

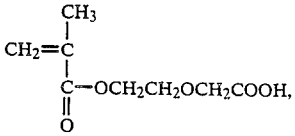

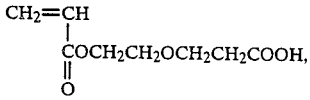

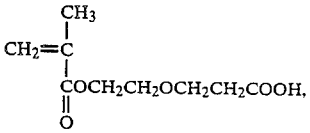

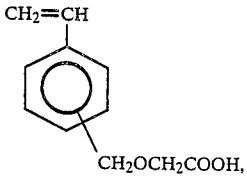

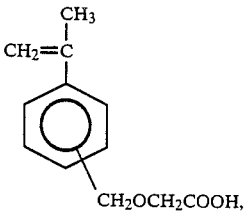

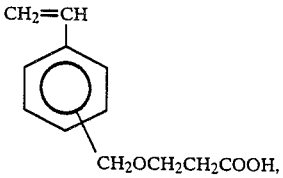

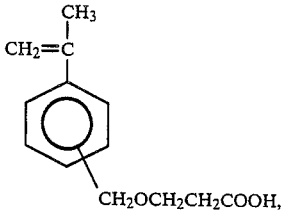

The suffix a represents a mole percentage of 30 to 70%, preferably 45 to 55%.

Specific examples of preferred copolymers of the present invention will be shown below, but the present invention should not be construed as being limited thereto.

(1)
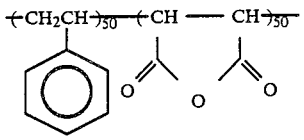
(2)
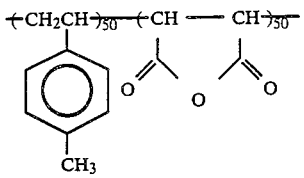
(3)
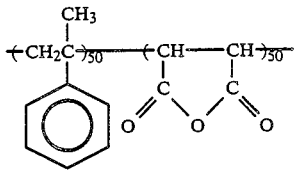
(4)
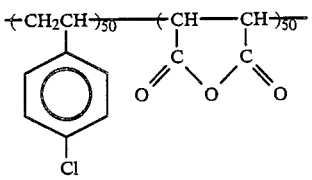
(5)
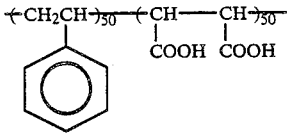
(6)
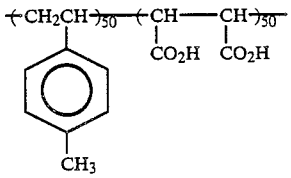
(7)
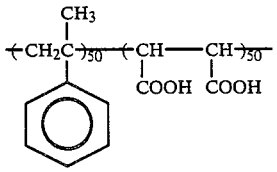
(8)
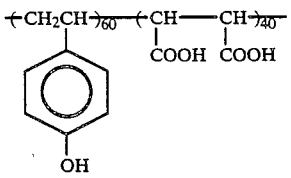
(9)
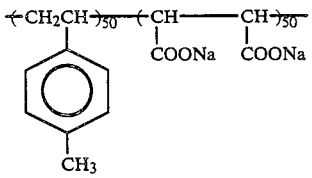
-continued
(10)
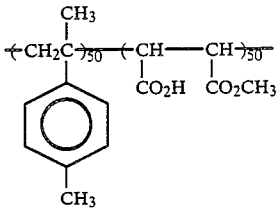
(11)
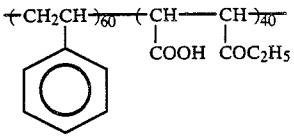
(12)
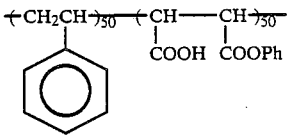
(13)
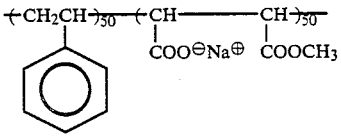
(14)
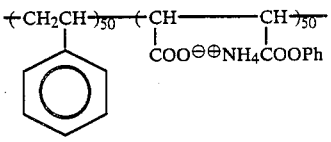
(15)
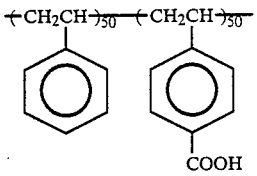
(16)
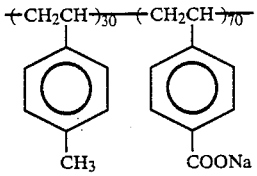
(17)
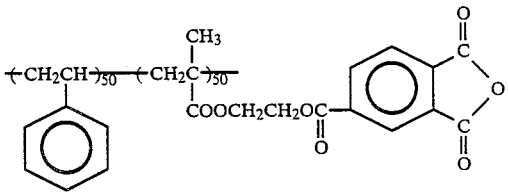
(18)
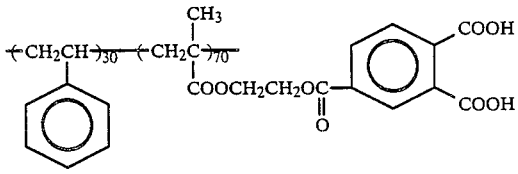

-continued

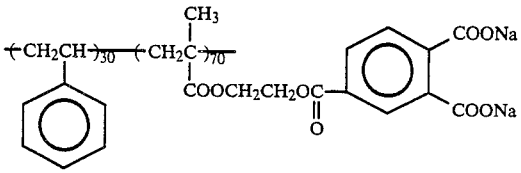

(19)

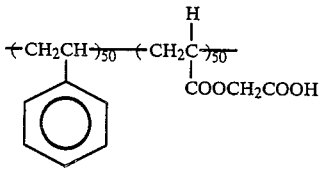

(20)

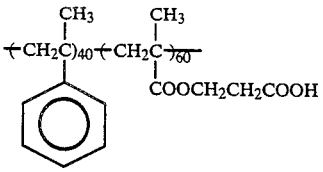

(21)

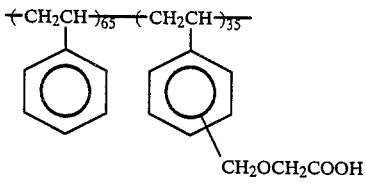

(22)

SYNTHESIS EXAMPLE 1

Synthesis of exemplary polymer (1)

A reflux condenser (zimroth condenser), a thermometer (temperature-sensing tube), and a dropping funnel were attached to a 1-l three neck flask. 17.8 g (0.17 mol) of styrene, 15,0 g (0.15 mol) of maleic anhydride, and 186 g (233 ml) of methyl ethyl ketone were put into the three neck flask. The three neck flask was heated in a hot water bath. When the temperature in the flask reached 60° C., a solution of 0.016 g (0.06 mmol) of a polymerization initiator V-65 (2,2'-azobisisovaleronitrile: commercially available from Wako Pure Chemical Industries, Ltd.) in 0.6 g of methyl ethyl ketone was put into the flask. The content of the flask was stirred at an internal temperature of 60° C. for 1 hour.

A solution of 41.4 g (0.40 mol) of styrene, 35.0 g (0.36 mol) of maleic anhydride, and 0.11 g (0.44 mmol) of V-65 in 16.8 g of methyl ethyl ketone was gradually added dropwise to the content of the flask through the dropping funnel. Upon the dropwise addition, care was taken to prevent rise in the internal temperature due to generation of polymerization heat. Thus, the dropwise addition was completed in 3 hours.

For the purpose of postpolymerization, a solution of 0.16 g (0.6 mmol) of V-65 in 2 g of methyl ethyl ketone was added to the content of the flask. The internal temperature of the flask was raised to 70° C. where reaction continued for 2 hours. 0.16 g of V-65 was again added to the reaction system. A second postpolymerization was then effected for 2 hours. The postpolymerization was again repeated. After the 3rd postpolymerization was completed, the heating was stopped. 234 g of methyl ethyl ketone was added to the reaction system. The internal temperature of the system was then lowered to room temperature. The reaction solution was dropwise added to a large excess of hexane to obtain a solid polymer.

Reduced Viscosity: $\eta sp/c$: 0.60 (0.5% acetone solution; 30° C.)

Solution Viscosity: $\eta$: 168 cp (15% methyl ethyl ketone solution; 25° C.)

Residual monomer (determined by gas chromatography):

Styrene: 1.6% (based on solid polymer content)

Maleic anhydride: 0.2% (based on solid polymer content)

SYNTHESIS EXAMPLE 2

Synthesis of exemplary polymer (5)

104 g (1 mol) of styrene, 116 g (1 mol) of maleic acid, and 300 ml of acetone were put into a 1-l three neck flask equipped with an agitator (Threeone Motor, available from Shinto Kagaku K.K.), a drip feeder (HEIDON Robopump, available from Shinto Kagaku K.K.), a reflux condenser (zimroth condenser), a thermometer, and a nitrogen introducing pipe. The admixture was stirred in an atmosphere of nitrogen. The reaction system was then heated under reflux at an internal temperature of 56° C. over a hot water bath. A solution comprising 13.8 g of dimethyl-2,2'-azobisisobutylate as a polymerization initiator in 30 ml of acetone was added to the reaction system in the flask. The reaction system was heated with stirring for 3 hours. 10.4 g (0.1 mol) of styrene was added dropwise to the reaction system through the drip feeder in 1 hour. After 30 minutes, a solution of 4.96 g of 2,2'-azobisisovaleronitrile in 30 ml of acetone was added to the reaction system. The reaction system was heated with stirring for 3 hours. The heating was then stopped. 200 ml of acetone was added to the reaction system. The reaction solution was added dropwise to water of an amount 10 times the weight of reaction solution to obtain a solid polymer.

Solution Viscosity $\eta$: 15.2 cp (20% acetone solution; 25° C.)

No residual monomer was detected by gas chromatography.

As a material constituting the present auxiliary neutralizing layer there may be singly using the present copolymer. In order to provide an optimum photographic property, the present copolymer may be preferably used in admixture with one or more other acidic polymers to adjust the neutralization behavior. Such an acidic polymer preferably has a good compatibility with the present copolymer or a refractive index close to that of the present copolymer. Furthermore, such an acidic polymer is preferably soluble in a common solvent with the present copolymer to facilitate the coating of the auxiliary neutralizing layer. Specific examples of such an acidic polymer include copolymers of vinyl monomer such as ethylene, vinyl acetate, and vinyl methyl ether with maleic anhydride, and alkyl half esters thereof, cellulose acetate, and cellulose acetate hydrogen phthalate.

The proportion of the present copolymer in the auxiliary neutralizing layer is 10 to 100% by weight based on the total weight of polymer contained in the auxiliary neutralizing layer. The added amount of the auxiliary neutralizing layer is properly determined by the alkaline processing solution to be neutralized, and the type and amount of the acidic polymer to be used in combination is preferably in the range of 0.5 to 5 g/m$^2$.

The neutralizing layer in the present neutralizing system may comprise an acidic material. As such an acidic material there can be used a known acidic material which is not specifically limited. A preferred example of such an acidic material is a material containing an acidic group of a pKa of 9 or less (or precursor group providing such an acidic group upon hydrolysis). Specific examples of preferred acidic material include higher aliphatic acids as described in U.S. Pat. No. 2,983,606, polymers of acrylic acid, methacrylic acid or maleic acid or copolymers of these acids with other monomers (such as methyl vinyl ether, styrene, ethylene, vinyl acetate), or partial esters or acid anhydrides thereof as disclosed in U.S. Pat. No. 3,362,819, copolymers of acrylic acid with acrylic ester as disclosed in French Patent No. 2,290,699, and latex type acidic polymers as disclosed in U.S. Pat. No. 4,139,383, and Research Disclosure No. 16102 (1977).

Other examples of such an acidic material include acidic materials as disclosed in U.S. Pat. No. 4,088,493, and Japanese Patent Application (OPI) Nos. 153739/77, 1023/78, 4540/78, 4541/78, and 4542/78.

Specific examples of such acidic polymers include copolymers of vinyl monomers such as ethylene, vinyl acetate, and methyl vinyl ether with maleic anhydride or n-butyl half esters thereof, copolymers of butyl acrylate with acrylic acid, and cellulose acetate hydrogen phthalate.

The polymer to be used in the 1st and 2nd neutralization timing layers may be either a latex polymer or a solvent-soluble polymer. Such a polymer may be either a homopolymer or a copolymer, preferably a copolymer.

Useful examples of such a polymer include polymers making the layer low in alkali permeability such as gelatin, polyvinyl alcohol, partially acetalized polyvinyl alcohol, cellulose derivatives (e.g. cellulose acetate), and partially hydrolyzed polyvinyl acetate, latex polymers providing a high alkali permeation activation energy obtained by copolymerization of a small amount of a hydrophilic comonomer such as acrylic monomer, and polymers containing lactone rings.

Particularly preferred examples of such a polymer include cellulose acetates as disclosed in Japanese Patent Application (OPI) No. 136328/79, and U.S. Pat. Nos. 4,267,262, 4,009,030, and 4,029,849, latex polymers obtained by copolymerization of a small amount of a hydrophilic comonomer such as acrylic acid as disclosed in Japanese Patent Application (OPI) Nos. 128335/79, 69629/81, and 6843/82, and U.S. Pat. Nos. 4,056,394, 4,061,496, 4,199,362, 4,250,243, 4,256,827, and 4,268,604, polymers containing lactone rings as disclosed in U.S. Pat. No. 4,229,516, and polymers as disclosed in Japanese Patent Application (OPI) Nos. 25735/81, 97346/81, and 6842/82, and European Patent Nos. 31,957A1, 37,724A1, and 48,412A1.

Other examples of such polymers which can be used in the present invention include polymers as described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431., West German Patent Application (OLS) Nos. 1,622,936, and 2,162,277, *Research Disclosure* No. 15162 (1976), and Japanese Patent Application (OPI) No. 202463/84.

These polymers to be used in the 1st and 2nd neutralization timing layers can be used singly or in combination. Alternatively, these polymers can be used in combination with polymers as described in Japanese Patent Application (OPI) Nos. 130929/79, 54341/80, 25735/81, 173834/82, and 179841/82, U.S. Pat. Nos. 4,029,849, 4,267,262, and 4,229,516, and European Patent 9795A2.

Specific examples of polymers as described in these patents include vinylidene chloride copolymers, conjugated diene copolymers, and maleic copolymers.

The mixing ratio of these polymers can be properly selected and is not specifically limited.

The 1st and 2nd timing layers may each consist of a combination of two or more layers so long as they comprise these polymers.

The auxiliary neutralizing layer, and the 1st and 2nd timing layers can comprise a development inhibitor and/or precursor thereof as disclosed in U.S. Pat. No. 4,009,029, West German Patent Application (OLS) Nos. 2,913,164, and 3,014,672, and Japanese Patent Application (OPI) Nos. 155837/79, 138745/80, 139365/80, 105640/84, 105641/84, and 105642/84, a hydroquinone precursor as disclosed in U.S. Pat. No. 4,201,578, or may have other photographic additives or precursors thereof incorporated therein.

The present photographic element may be a light-sensitive material containing a neutralizing system, a cover sheet comprising a neutralizing system laminated on a light-sensitive material, an image-receiving material containing a neutralizing system, an integrated body of an image-receiving element, a light-sensitive element, a cover sheet containing a neutralizing system, and a processing element, or an integrated body of an image-receiving element containing a neutralizing system, a light-sensitive element, and a processing element. If the photographic element is such an integrated film unit, the element may optionally be peeled off the support.

The reproduction of natural colors by the subtractive process is accomplished with a light-sensitive material consisting of at least two combinations of a silver halide emulsion having a selective spectral sensitivity in a predetermined wavelength range and a dye-image forming compound (hereinafter referred to as "coloring material") having a selective spectral absorption in the same wavelength range (or coloring material containing a group forming such a dye).

If the present photographic element is a light-sensitive material or a film unit, it advantageously comprises a light-sensitive element consisting of a combination of a blue-sensitive silver halide emulsion and a yellow coloring material, a combination of a green-sensitive emulsion and a magenta coloring material, and a combination of a red-sensitive emulsion and a cyan coloring material. These combination units of emulsion and coloring material may be laminated in layers in face-to-face relation in the light-sensitive material or may be in the form of a mixture of particles thereof which are coated as one layer. (In the latter form, a coloring material and particulate silver halide exist in the same particles.)

Examples of a coloring material which releases a diffusive dye for forming a transfer image will be described hereinafter.

The coloring material which can be preferably used in the present invention is a DDR (Dye-Releasing Redox) compound of the undermentioned general formula which is substantially immoble under an alkaline processing condition.

(Ballast)-(Redox cleavage atomic group Dye)

wherein (Ballast) represents a group which is adapted to substantially immobilize the DDR compound under an alkaline processing condition. (Ballast) group is not needed if (Redox cleavage atomic group Dye) is substantially immobile by itself. (Dye) represents a dye group or precursor which can migrate in the light-sensitive element at least under an alkaline processing condition when separated from the DDR compound. (Redox cleavage atomic group) represents a group which undergoes cleavage by oxidation or reduction under an alkaline condition.

Examples of such a redox cleavage atomic group include those as dsscribed in U.S. Published patent application Ser. No. B 351,673, U.S. Pat. Nos. 3,928,312, 4,055,428, 4,053,312, 4,336,322, 3,443,930, 3,443,939, 3,628,952, 3,844,785, 3,443,943, 3,980,479, 4,278,750, 4,139,379, 4,218,368, 4,183,753, 4,142,891, 3,421,964, and 4,199,355, and Japanese Patent Application (OPI) Nos. 50736/78, 104343/76, 46730/78, 130122/79, and 110827/78. The dye released from the coloring material used in the present invention may be an existing dye or a dye precursor which can be converted to a dye at the photographic processing step or additional processing step. The final image dye may optionally be a metal complex dye. Examples of typical dye structures of coloring materials useful in the present invention include azo dyes, azomethine dyes, anthraquinone dyes, and phthalocyanine dyes which may be optionally metal complexed. Particularly preferred among these dyes are cyan, magenta and yellow dyes.

Examples of such yellow dyes are described in U.S. Pat. Nos. 3,597,200, 3,309,199, 4,013,633, 4,245,028, 4,156,609, 4,139,383, 4,195,922, 4,148,641, and 4,148,643, Japanese Patent Application (OPI) Nos. 114930/76, 16130/81, and 71072/81, and *Research Disclosure* Nos. 17630 (1978), and 16475 (1977).

Examples of such magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and Japanese Patent Application (OPI) Nos. 106727/77, 23628/78, 36804/80, 73057/81, 71060/81, and 134/80.

Examples of such cyan dyes are described in U.S. Pat. Nos. 3,482,972, 3,929,760, 4,013,635, 4,268,625, 4,171,220, 4,242,435, 4,142,891, 4,195,994, 4,147,544, and 4,148,642, British Patent No. 1,551,138, Japanese Patent Application (OPI) Nos. 99431/79, 8827/77, 47823/78, 143323/78, 99431/79, and 71061/81, European Pat. Nos. 53,037, and 53,040, and *Research Disclosure* Nos. 17630 (1978), and 16475 (1977).

A useful form of such a dye precursor is a dye precursor containing a dye portion whose light absorption has been temporarily shifted in the light-sensitive element.

A coloring material particularly useful in the present invention is a negative working DRR compound which releases a dye upon oxidation under an alkaline condition. Other useful examples of coloring materials include couplers which release a diffusive dye as described in U.S. Pat. No. 3,227,550, and dye devoloping agents.

As silver halide to be contained in the present photographic emulsion there can be used any one of silver bromide, silver iodobromide, silver iodochlorobromide, silver chlorobromide, and silver chloride, or a mixture thereof. A preferred silver halide is silver bromide, silver iodobromide, or silver iodochlorobromide containing 20 mol % or less of iodide and 30 mol % or less of chloride. Particularly preferred among these silver halides is silver bromide.

The present silver halide emulsion is preferably of the internal latent image type in which a latent image is formed mainly inside silver halide grains. The present silver halide emulsion also preferably is a direct reversal photographic emulsion which forms a direct positive image when used in combination with a nucleating agent.

Such an internal latent image type silver halide emulsion can be distinctly defined by the fact that the maximum density obtained when developed with an internal type developing solution is greater than that obtained when developed with a surface type developing solution. A suitable internal latent image type emulsion in the present invention is such that the maximum density obtained when it is coated on a transparent support, exposed to light for a fixed time of 0.01 to 1 second, and developed with the undermentioned developing solution A (internal type developing solution A) at a temperature of 20° C. for 3 minutes is at least 5 times that obtained when the same coat of silver halide emulsion is exposed to light in the same manner, and developed with the undermentioned developing solution B (surface type developing solution) at a temperature of 20° C. for 4 minutes. The maximum density was measured by an ordinary photographic density measurement process.

| Developing solution A | |
|---|---|
| Hydroquinone | 15 g |
| Monomethyl-p-aminophenol sesquisulphate | 15 g |
| Sodium sulfite | 50 g |
| Potassium bromide | 10 g |
| Sodimm hydroxide | 25 g |
| Sodium thiosulfate | 20 g |
| Water to make | 1 l |

| Developing solution B | |
|---|---|
| p-Oxyphenyl glycine | 10 g |
| Sodium carbonate | 100 g |
| Water to make | 1 l |

The internal latent image type silver halide emulsion to be used in the present invention is a hydrophilic colloidal dispersion of silver chloride, silver bromide, silver chlorobromide, silver iodobromide, silver iodochlorobromide, or a mixture thereof. The halogen composition of the emulsion can be properly determined by the purpose and processing condition of the light-sensitive material. A particularly preferred halogen composition is silver bromide, silver iodobromide, or silver iodochlorobromide containing 10 mol % or less of iodide and 30 mol % or less of chloride. Specific examples of such preferred emulsions include emulsions as described in U.S. Pat. No. 2,592,250, and conversion type emulsions, core/shell type emulsions, and emulsions doped with foreign metals as described in British Pat. No. 1,027,146, and U.S. Pat. Nos. 3,206,313, 3,511,662, 3,447,927, 3,737,313, 3,761,276, and 3,935,014. However, the present invention should not be construed as being limited to these emulsions.

The present photographic element may comprise various photographic supports as disclosed, for example, in *Research Disclosure* No. 17643 (1978).

If the present photographic element is an image-receiving material or a film unit, the image-receiving element in the photographic element may contain at least a mordant layer (image-receiving layer). Such a mordant layer preferably comprise a polymer mordant. As such a polymer mordant there may be used a polymer containing a secondary or tertiary amino group, a polymer containing a nitrogen-containing heterocyclic portion, or a polymer containing a quarternary cation group thereof. Such a polymer preferably has a molar weight of 5,000 or more, particularly 10,000 or more.

Specific examples of such a polymer include vinyl pyridine polymers and vinyl pyridinium cation polymers as disclosed in U.S. Pat. Nos. 2,548,564, 2,484,430, 3,148,061, and 3,756,814, vinylimidazolium cation polymers as disclosed in U.S. Pat. No. 4,123,386, polymer mordants crosslinkable with gelatin as disclosed in U.S. Pat. Nos. 3,625,694, 3,859,096, and 4,128,538, and British Pat. No. 1,277,453, aqueous sol type mordants as disclosed in U.S. Pat. Nos. 3,958,995, 2,721,852, and 2,798,063, and Japanese Patent Application (OPI) Nos. 115228/79, 145529/79, 126027/79, 155835/79, and 17352/81, water-insoluble mordants as disclosed in U.S. Pat. No. 3,898,088, reactive mordants capable of being covalently bonded to a dye as disclosed in U.S. Pat. Nos. 4,168,976, and 4,201,840, and mordants as disclosed in U.S. Pat. Nos. 3,709,690, 3,788,855, 3,642,482, 3,488,706, 3,557,066, 3,271,147, and 3,271,148, Japanese Patent Application (OPI) Nos. 30328/78, 155528/77, 125/78, 1024/78, and 107835/78, and British Pat. No. 2,064,802.

Other examples of such a polymer include mordants as disclosed in U.S. Pat. Nos. 2,675,316, and 2,882,156.

A preferred example of an image-receiving layer which mordants an azo dye containing a chelating group is an image-receiving layer comprising transition metal ions and a polymer capable of immobilizing said transition metal ions incorporated in a mordant layer or adjacent layers thereof. Examples of polymers capable of immobilizing transition metal ions are described in Japanese Patent Application (OPI) Nos. 48210/80, and 129346/80, and U.S. Pat. Nos. 4,273,853, 4,282,305, 4,193,796, 4,288,511, and 4,241,163.

The processing composition to be used for the processing of the present light-sensitive material preferably contains a base such as sodium hydroxide, potassium hydroxide, sodium carbonate, and sodium phosphate so as to have an alkaline strength of pH of about 9 or more, preferably 11.5 or more. The processing composition may contain an oxidation inhibitor such as sodium sulfite, ascorbate, and piperidinohexose reductone. The processing composition may also contain a silver ion concentration adjustor such as potassium bromide. Furthermore, the processing composition may contain a thickening compound such as hydroxyethyl cellulose, and sodium carboxymethyl cellulose.

Moreover, the alkaline processing solution may contain a compound which serves to accelerate development or transfer of dye. Examples of such a compound include benzyl alcohol. The developing agent may be incorporated in the processing composition. Alternatively, the processing composition may be partially incorporated in a proper layer (e.g. silver halide emulsion layer, coloring material-containing layer, intermediate layer, and image-receiving layer) in the light-sensitive material (or film unit).

Specific examples of such a developing agent include hydroquinone compounds such as hydroquinone, 2,5-dichorohydroquinone, and 2-chlorohydroquinone, aminophenol compounds such as 4-aminophenol, N-methylaminophenol, 3-methyl-4-aminophenol, and 3,5-dibromoaminophenol, catechol compounds such as catechol, 4-cyclohexylcatechol, 3-methoxycatechol, and 4-(N-coctadecylamino)catechol, phenylenediamine compounds such as N,N-diethyl-p-phenylenediamine, 3-methyl-N,N-diethyl-p-phenylenediamine, 3-methoxy-N-ethyl-N-ethoxy-p-phenylenediamine, and N,N,N',N'-tetramethyl-p-phenylenediamine, and 3-pyrazolidone compounds such as 1-phenyl-3-pyrazolidone, 1-phenyl-4,4,-dimethyl-3-pyrazolidone, 4-hydroxymethyl-4-methyl-1-phenyl-3-pyrazolidone, 1-m-tolyl-3-pyrazxolidone, 1-p-tolyl-4-methyl-4-hydroxymethyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-pyrazolidone, 1-(m-chlorophenyl)-4-methyl-3-pyrazolidone, 1-(p-chlorophenyl)-4-methyl-3-pyrazolidone, 1-(m-chlorophenyl)-3-pyrazolidone, 1-(p-chlorophenyl)-3-pyrazolidone, 1-(p-tolyl)-4-methyl-3-pyrazolidone, 1-(o-tolyl)-4-methyl-3-pyrazolidone, 1-(p-tolyl)-3-pyrazolidone, 1-(m-tolyl)-4,4-dimethyl-3-pyrazolidone, 1-(2-trifluoroethyl)-4,4-dimethyl-3-pyrazolidone, and 5-methyl-3-pyrazolidone. Particularly preferred among these developing agents are 3-pyrazolidone compounds.

These developing agents may be used in combination as disclosed in U.S. Pat. No. 3,039,869.

The present invention will be further illustrated in the following examples, but the present invention should not be construed as being limited thereto. Unless otherwise specified, all amounts, percentages and ratios are based on weight.

EXAMPLE 1

Cover sheet

A comparative cover sheet (i) was prepared by coating the undermentioned layers (1) to (3) on a transparent polyethylene terephthalate support in order.

(1) A neutralizing layer comprising a coat of 11 g/m$^2$ of acrylic acid-butylacrylate (weight ratio 8/2) having an average molecular weight of 50,000 and 0.22 g/m$^2$ of 1,4-bis(2,3-epoxypropoxy)-butane.

(2) A layer containing 4.5 g/m$^2$ of cellulose acetate having an acetylation degree of 51.0% and a methyl vinyl ether-maleic monomethyl ester alternating copolymer in a weight ratio of 95/5 and 2.6 mmol/m$^2$ of 5-(2-cyano-1-methylthio)-1-phenyltetrazole.

(3) A 2-μ thick layer comprising a coat of a 6/4 (solid content) mixture of a 49.7/42.3/3/5 (weight) copolymer latex of styrene-n-butylacrylate-acrylic acid-N-methylolacrylamide and a 93/4/3 (weight) copolymer latex of methylmethacrylate-acrylic acid-N-methylolacrylamide.

A comparative cover sheet (ii) was prepared by coating the undermentioned layers (1) to (4) on a transparent polyethylene terephthalate support in order.

(1) A neutralizing layer comprising a coat of 10 g/m$^2$ of a 8/2 (weight) acrylic acid-butylacrylate copolymer having an average molecular weight of 50,000 and 0.2 g/m$^2$ of 1,4-bis(2,3-epoxypropoxy)-butane.

(2) A second timing layer comprising a coat of 7.5 g/m$^2$ of a cellulose acetate having an acetylation degree of 51.0% and a methyl vinyl ether-maleic monomethyl ester alternating copolymer in a weight ratio of 95/5.

(3) An auxiliary neutralizing layer containing 1.05 g/m$^2$ of a methyl vinyl ether-maleic anhydride alternating copolymer and 0.98 mmol/m$^2$ of 5-(2-cyano-1-methylthio)-1-phenyltetrazole.

(4) A 2-$\mu$ thick first timing layer comprising a coat of a 6/4 (solid content) mixture of a 49.7/42.3/3/5 (weight) copolymer latex of styrene-n-butylacrylate-acrylic acid-N-methylolacrylamide and a 93/4/3 (weight) copolymer latex of methylmethacrylate-acrylic acid-N-methylolacrylamide.

Cover sheets (iii) to (ix) of the present invention were prepared in the same manner as in the comparative cover sheet (ii) except in that the methyl vinyl ether-maleic anhydride alternating copolymer in the auxiliary neutralizing layer of the comparative cover sheet (ii) was partially replaced by copolymers of the present invention shown in Table 1.

TABLE 1

| Cover sheet No. | Present copolymer | Added amount (weight %) |
|---|---|---|
| (iii) | (1) | 30 |
| (iv) | (5) | 10 |
| (v) | " | 30 |
| (vi) | " | 50 |
| (vii) | " | 100 |
| (viii) | (15) | 30 |
| (ix) | (17) | 30 |

Light-sensitive sheet

A light-sensitive sheet was prepared by coating the undermentioned layers on a transparent polyethylene terephthalate support.

(1) A mordant layer containing 3.0 g/m$^2$ of gelatin and 3.0 g/m$^2$ of a polymer latex mordant of the general formula:

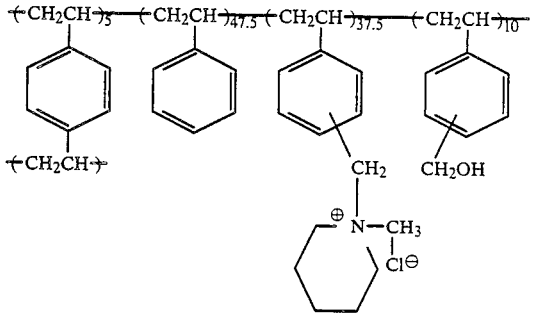

(2) A white reflecting layer containing 18 g/m$^2$ of titanium dioxide and 2.0 g/m$^2$ of gelatin.

(3) A backing layer containing 2.0 g/m$^2$ of carbon black and 1.0 g/m$^2$ of gelatin.

(4) A layer containing 0.44 g/m$^2$ of a cyan dye-releasing redox compound of the undermentioned general formula, 0.09 g/m$^2$ of tricyclohexyl phosphate, 0.008 g/m$^2$ of 2,5-di-t-pentadecyl hydroquinone, and 0.8 g/m$^2$ of gelatin.

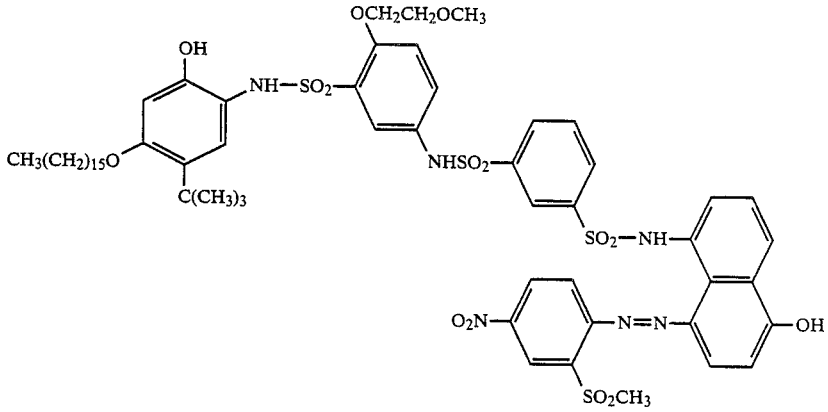

(5) A red-sensitive emulsion layer containing a red-sensitive internal latent image type direct positive silver bromide emulsion in an amount of 1.03 g/m$^2$ (in terms of silver), 1.2 g/m$^2$ of gelatin, 0.04 mg/m$^2$ of a nucleating agent of the undermentioned general formula, and 0.13 g/m$^2$ of sodium salt of 2-sulfo-5-n-pentadencylhydroquinone.

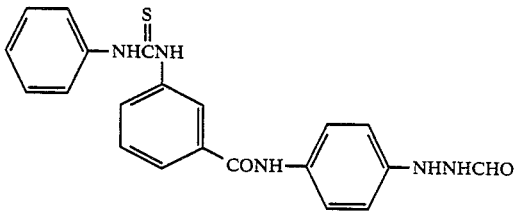

(6) A layer containing 0.43 g/m$^2$ of 2,5-di-t-pentadecylhydroquinone, 0.1 g/m$^2$ of trihexyl phosphate, and 0.4 g/m$^2$ of gelatin.

(7) A layer containing 0.40 g/m$^2$ of a magenta dye-releasing redox compound of the undermentioned structural formula, 0.08 g/m$^2$ of tricyclohexyl phosphate, and 0.9 g/m$^2$ of gelatin.

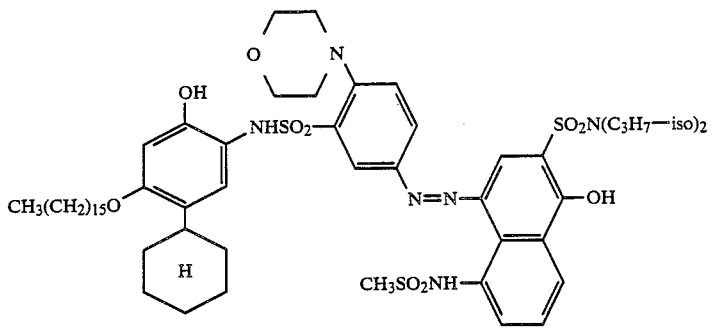

(8) A green-sensitive emulsion layer containing a green-sensitive internal latent image type direct positive silver bromide emulsion in an amount of 0.82 g/m$^2$ (in terms of silver), 0.9 g of gelatin, 0.03 mg/m$^2$ of the same nucleating agent as used in the layer (5), and 0.08 g/m$^2$ of sodium salt of 2-sulfo-5-n-pentadecylhydroquinone.

(9) Same as the layer (6).

(10) A layer containing 0.53 g/m$^2$ of a yellow dye-releasing redox compound of the undermentioned structural formula, 0.13 g/m$^2$ of tricyclohexyl phosphate, and 0.7 g/m$^2$ of gelatin.

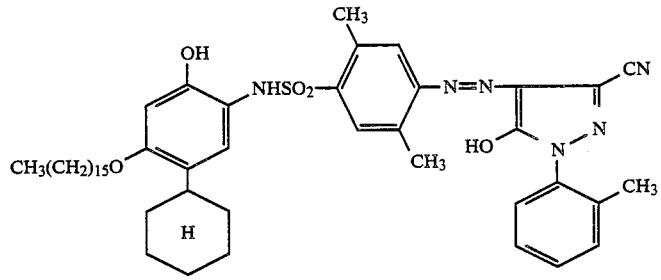

(11) A blue-sensitive emulsion layer containing a blue-sensitive internal latent image type direct positive silver bromide emulsion in an amount of 1.09 g/m$^2$ (in terms of silver), 1.1 g/m$^2$ of gelatin, 0.04 mg/m$^2$ of the same nucleating agent as used in the layer (5), and 0.07 g/m$^2$ of sodium salt of 2-sulfo-5-n-pentadecylhydroquinone.

(12) A layer containing 1.0 g/m$^2$ of gelatin.

The light-sensitive sheet thus prepared was exposed to light through a color test chart. The above described present cover sheets (iii) to (ix) and comparative cover sheets (i) and (ii) were each laminated on a thus exposed light-sensitive sheet. The undermentioned processing solution was then spread evenly through the gap between the two sheets to a thickness of 85 μm at a temperature of 25° C. by means of a pressure roller.

| Processing solution | |
|---|---|
| 1-p-Tolyl-4-hydroxymethyl-4-methyl-3-pyrazolidone | 6.9 g |
| Methyl hydroquinone | 0.3 g |
| 5-Methylbenzotriazole | 3.5 g |
| Sodium sulfite (anhydride) | 0.2 g |
| Sodium salt of carboxymethyl cellulose | 58 g |
| Potassium hydroxide (28% aqueous solution) | 200 cc |
| Benzyl alcohol | 1.5 cc |
| Carbon black | 150 g |

-continued

| Processing solution | |
|---|---|
| Water | 685 cc |

After 1 hour, the light-sensitive sheet was measured for red, green and blue densities. The light-sensitive sheet was then stored in a dark place at room temperature for 14 days. The light-sensitive sheet was again measured for image density. Taking the difference $\Delta D_{max}$ in the maximum density $D_{max}$ between after 14-day storage and after 1-hour as the measure of after-transfer, the results shown in Table 2 were obtained. The less $\Delta D_{max}$ shown in Table 2 is, the better the after-transfer characteristics.

The above described light-sensitive sheet was exposed to light through a fine line test chart for sharpness evaluation. The above described comparative cover sheets (i) and (ii) and present cover sheets (iii) to (ix) were each laminated on a thus exposed light-sensitive sheet. The above described processing solution was then spread evenly through the gap between the two sheets to a thickness of 85 μm at a temperature of 25° C. After being allowed to stand for 1 day, the light-sensitive sheet was measured for sharpness through a green filter by means of a microdensitometer. The space frequency at which C.T.F. (Contrast Transfer Frequency) is 0.5 was determined. The results shown in Table 2 were obtained. The greater the space frequency shown in Table 2 is, the better the sharpness is.

TABLE 2

| Cover Sheet No. | Aftertransfer: $\Delta D_{max}$ (1 hr and 14 days) B | G | R | Sharpness* |
|---|---|---|---|---|
| i (Comparison) | 0.15 | 0.35 | 0.18 | 2.61 |
| ii (Comparison) | 0.08 | 0.16 | 0.12 | 2.92 |
| iii (Invention) | 0.08 | 0.16 | 0.12 | 2.93 |
| iv (Invention) | 0.08 | 0.17 | 0.13 | 2.93 |
| v (Invention) | 0.08 | 0.17 | 0.13 | 2.95 |
| vi (Invention) | 0.09 | 0.19 | 0.14 | 2.98 |

TABLE 2-continued

| Cover Sheet No. | Aftertransfer: $\Delta D_{max}$ (1 hr and 14 days) B | G | R | Sharpness* |
|---|---|---|---|---|
| vii (Invention) | 0.10 | 0.21 | 0.15 | 3.02 |
| viii (Invention) | 0.08 | 0.16 | 0.13 | 2.93 |
| ix (Invention) | 0.08 | 0.18 | 0.14 | 2.96 |

*Space frequency at which C.T.F. is 0.5

Table 2 shows that the comparative cover sheet (ii) and present cover sheets (iii) to (ix) consisting of the first timing layer, auxiliary neutralizing layer, second timing layer and neutralizing layer have remarkably improved sharpness and aftertransfer characteristics as compared to the conventional cover sheet (comparative sheet (i)). The combined use of the present copolymer doesn't cause a big change in sharpness and aftertransfer characteristics. However, Table 2 shows that sharpness and aftertransfer characteristics can be somewhat adjusted by altering the mixing ratio of the present copolymer.

EXAMPLE 2

The Specimen identical to those which had been measured for aftertransfer characteristics in Example 1 were stored in a dark place at a temperature of 60° C. and a relative humidity of 70% for 2 weeks and for 3 weeks. Each specimen was measured for image density in the same manner as in Example 1. The difference ($\Delta D_{max}{}^G$) in the maximum density on the green portion $D_{max}{}^G$ between the initial value (after 1 hour) and the value after 2-week and 3-week storage was determined as the measure of image preservability. A positive value of $\Delta D_{max}{}^G$ indicates intensification. On the contrary, a negative value of $\Delta D_{max}{}^G$ indicates discoloration. The less the absolute value of $\Delta D_{max}{}^G$ is, i.e. the less the change in $D_{max}$ from the initial value (after 1 hour) is, the better is the image preservability. The results are shown in Table 3.

TABLE 3

| Cover sheet No. | $\Delta D_{max}{}^G$ 1 hour → 2 weeks | 1 hour → 3 weeks |
|---|---|---|
| i (Comparison) | +0.10 | +0.05 |
| ii (Comparison) | −0.12 | −0.17 |
| iii (Invention) | +0.02 | ±0 |
| iv (Invention) | −0.05 | −0.10 |
| v (Invention) | ±0 | −0.02 |
| vi (Invention) | +0.04 | +0.01 |
| vii (Invention) | +0.07 | +0.04 |
| viii (Invention) | +0.01 | −0.02 |
| ix (Invention) | −0.01 | −0.03 |

Table 3 shows that the comparative cover sheet (i) exhibited a big color intensification change from the initial value (1 hour storage) and the comparative cover sheet (ii) exhibited a big discoloration change from the initial value (1 hour storage) while the present cover sheets (iii) to (ix) exhibited a small $\Delta D_{max}{}^G$ from the inital value both in color intensification and discoloration and a small discoloration change after 2-week storage and after 3-week storage, showing an excellent image preservability. Table 3 also shows that the image preservability can be freely adjusted by properly selecting the type and mixing ratio of the present copolymer.

From the results of Examples 1 and 2, it can be concluded that the present neutralizing system can provide improved sharpness and aftertransfer characteristics and an excellent image preservability.

As has been described above, the present color diffusion transfer photographic element can inhibit aftertransfer and provide a transfer image excellent in sharpness. The transfer image thus obtained exhibits an excellent preservability.

While the invention has been described in detail and with reference to specific embodiment thereof, it will be apparent to one skilled in the art that various changes and modifications can be made therein without departing from the spirit and scope thereof.

What is claimed is:

1. A photographic element comprised of a light-sensitive dye release sheet comprising silver halide and dye release compounds wherein said dye release compounds are capable of releasing dye in the presence of an alkaline processing solution and stop development at a first pH determined by a neutralization system defined below, a receiving sheet and a cover sheet, wherein development, dye release and dye transfer occur in the presence of an alkaline processing solution, and wherein said cover sheet is provided with a neutralizing system which causes neutralization by an alkaline processing solution to proceed by at least a first and a second stage, wherein the first stage is characterized in that neutralization of the pH of an alkaline processing solution occurs to the extent to interrupt development and dye release reactions but at which the transfer of a dye for forming a transfer image can continue, and a second stage at which the pH of the processing solution is gradually lowered to a final value which is stably maintained over prolonged storage, said photographic element characterized in that the neutralizing system comprises at least a neutralizing layer, a second neutralization timing layer, an auxiliary neutralizing layer and a first neutralization timing layer as viewed from the support side, and that said auxiliary neutralizing layer contains from 10 to 100% by weight of a polymer containing as a constituent a monomer unit represented by the general formula (I):

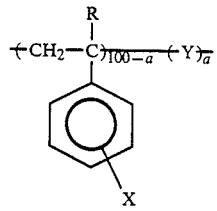

(I)

wherein R represents a hydrogen atom or substituted or unsubstituted alkyl group; X represents a hydrogen atom, a substituted or unsubstituted alkyl group, a hydroxy group, a cyano group, or a halogen atom; Y represents a monomer unit obtained by copolymerization of at least one monomer selected from copolymerizable ethylenically unsaturated carboxylic acid, acid anhydride, half ester of acid anhydride, and salts thereof; and a represents a mole percentage of 30 to 70%.

2. A photographic element claimed in claim 1, wherein said polymer containing as a constituent a monomer unit represented by the general formula (I) is a copolymer represented by the general formula (II):

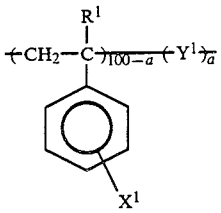

(II)

wherein $R^1$ represents a hydrogen atom or a substituted or unsubstituted alkyl group containing 1 to 6 carbon atoms; $X^1$ represents a hydrogen atom, a substituted or unsubstituted alkyl group, a cyano group, or a halogen atom; $Y^1$ represents a copolymerizable ethylenically unsaturated carboxylic acid monomer, acid anhydride monomer, half ester monomer of acid anhydride, or salt thereof; and a represents a mole percentage of 30 to 70%.

3. A photographic element as in claim 1, wherein a represents a mole percentage of 45 to 55%.

4. A photographic element as in claim 1, wherein R is selected from the group consisting of a hydrogen atom, a methyl group, an ethyl group, a hydroxymethyl group, a halomethyl group wherein halogen is chlorine, bromine or iodine, and a cyanomethyl group; and X is selected from the group consisting of a hydrogen atom, a methyl group, an ethyl group, a n-propyl group, an isopropyl group, a n-butyl group, an amyl group, a n-hexyl group, a n-dodecyl group, a hydroxy group, a cyano group, or a chlorine, bromine, or iodine atom.

5. A photographic element as in claim 1, wherein R is a hydrogen atom or a methyl group and X is a hydrogen atom, a methyl group, a hydroxy group, or a chlorine atom.

6. A photographic element as in claim 1, wherein the light-sensitive sheet is a light-sensitive silver halide emulsion layer comprised of internal latent image type silver halide grains.

7. A photographic element as in claim 1, wherein the auxiliary neutralizing layer contains, in admixture with said polymer containing as a consitituent a monomer unit represented by the general formula (I), one or more other acidic polymers.

8. A photographic element as in claim 7, wherein said other acidic polymers are selected from the group consisting of copolymers of vinyl monomers selected from ethylene, vinyl acetate, and vinyl methyl ether with maleic anhydride, and alkyl half esters thereof, cellulose acetate, and cellulose acetate hydrogen phthalate.

9. A photographic element as in claim 1, wherein monomer units copolymerized to produce Y are one or more monomers selected from the group consisting of

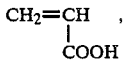

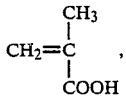

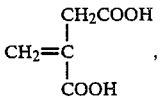

-continued

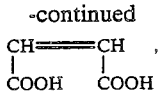

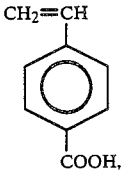

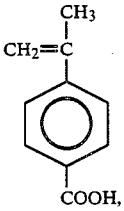

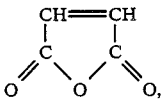

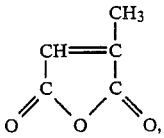

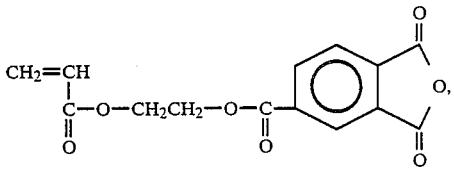

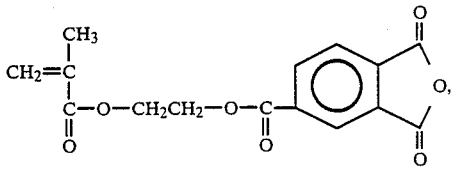

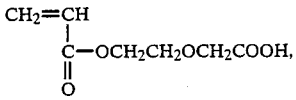

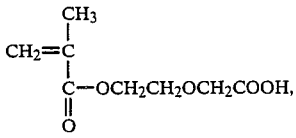

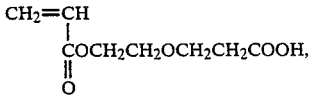

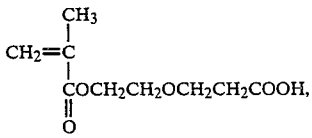

-continued
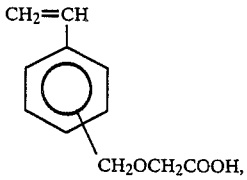
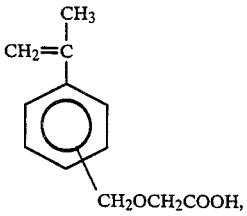
-continued
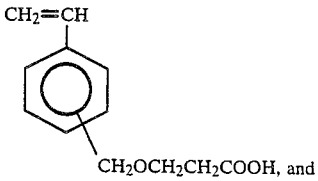
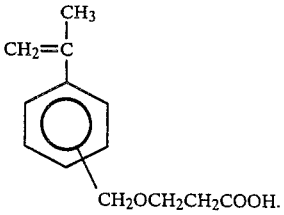
* * * * *